US006260981B1

(12) United States Patent
Fiene

(10) Patent No.: US 6,260,981 B1
(45) Date of Patent: Jul. 17, 2001

(54) LUMINAIRES, PRIMARILY FOR SUSPENDED CEILINGS, CAPABLE OF BEING NESTED TO REDUCE SHIPPING AND STORAGE VOLUME

(75) Inventor: Dale E Fiene, Algonquin, IL (US)

(73) Assignee: Ole K. Nilssen, Bonita Springs, FL (US)

( * ) Notice: Subject to any disclaimer, the term of this patent is extended or adjusted under 35 U.S.C. 154(b) by 0 days.

(21) Appl. No.: 09/410,805

(22) Filed: Oct. 1, 1999

(51) Int. Cl.[7] ..... F21S 8/00

(52) U.S. Cl. ..... 362/147; 362/265; 362/354; 362/290

(58) Field of Search ..... 362/263, 265, 362/354, 290, 147

(56) References Cited

U.S. PATENT DOCUMENTS

| | | | |
|---|---|---|---|
| 4,626,747 | 12/1986 | Nilssen | 315/209 R |
| 4,631,648 | 12/1986 | Nilssen | 362/150 |
| 4,651,059 | 3/1987 | Nilssen | 315/182 |
| 4,667,133 | 5/1987 | Nilssen | 315/312 |
| 5,003,227 | 3/1991 | Nilssen | 315/161 |
| 5,047,696 | 9/1991 | Nilssen | 315/312 |
| 5,479,326 | 12/1995 | Nilssen | 362/148 |
| 5,640,069 | 6/1997 | Nilssen | 315/209 R |
| 5,691,603 | 11/1997 | Nilssen | 315/209 R |

*Primary Examiner*—Sandra O'Shea
*Assistant Examiner*—Ronald E. DelGizzi

(57) ABSTRACT

A luminaire design for suspended ceilings, which permits improved packing density for the warehousing and shipping. The assembled luminaire comprises three or four parts: a reflector, a ballasted-socket, a lamp, and an optional diffuser or lens. The tapered design of the reflector allows the reflectors to be stored and transported with one reflector nested within another; therefore, a stack of a dozen luminaires take up only slightly more volume than one conventional luminaire. When the luminaires are installed at the job site, a ballasted-socket is clipped into a mounting hole in the reflector, a lamp is inserted into the socket of the ballasted-socket, this assembly is placed into the ceiling grid, and the ballasted-socket is connected to a power source. If a diffuser or lens is desired, it is merely placed in the ceiling grid before the rest of the assembly.

55 Claims, 6 Drawing Sheets

LUMINAIRES, PRIMARILY FOR SUSPENDED CEILINGS, CAPABLE OF BEING NESTED TO REDUCE SHIPPING AND STORAGE VOLUME

BACKGROUND

1. Field of Invention

This invention relates to luminaires in general, and to lightweight, field-assembled luminaires for suspended ceilings in particular.

2. Description of Prior Art

Current fluorescent luminaires are connected to the utility power line via conduit, BX, or Romex type cable. Since the fluorescent luminaire is connected directly to the utility power line via a 15 or 20 amp branch circuit, the luminaire must be designed to enclose and protect the input leads to the fluorescent lamp ballast, the lamp sockets, and the interconnecting leads between the ballast and the lamp sockets. In order to provide the necessary protection, fluorescent luminaires are made out of relatively heavy gauge steel to meet specific standards set by Underwriters' Laboratories (UL), such as, UL1570. UL requires that heavy gauge metal be used to insure that the luminaire can withstand a certain degree of abuse without exposing leads, electrical components, the ballast, current carrying parts or devices with exposed metal which could constitute a shock or fire hazard.

Due to the structural requirement set out in the UL standard a typical 2×4 foot luminaire can weigh over 30 pounds and a 2×2 foot fixture can weigh over 15 pounds. Since current luminaires act as electrical enclosures for the fluorescent ballast and the interconnecting leads, raceway covers (also made out of heavy gauge steel) are provided to contain the potentially hazardous wiring. Luminaires, currently on the market, often contain 25 to 30 stamped metal parts plus the fasteners to hold them all together.

Because these luminaires contain such a large number of parts, they are assembled in factories, where they are packaged in individual boxes. Then they are loaded onto trucks, shipped to and stored in warehouses. They are then loaded onto different trucks and delivered to lighting wholesalers and retailers or job sites where they are stored until they are installed. In each case, the luminaires occupy a significant amount of floor space and volume.

Once at the job site the luminaires are lifted overhead into position within the ceiling grid. This is no easy task since each 2×4 luminaire can weigh 30 pounds or more. The grid system and the supporting wires are required to be sufficiently strong to accommodate this extra weight.

Fluorescent lamp ballasts currently in production are designed to operate from 15 or 20 amp branch circuits, which are typically 120, 240, or 277 volts; 60 Hertz. Due to the high energy levels available from these branch circuits, the lines connecting the input to the ballast to the branch circuit is required by the local electrical code to be run in conduit, BX, or Romex. The output leads connect the ballast to the lamp sockets and supply voltages and currents which do not meet the limits of the National Electrical Code requirements for either Class II or Class III wiring. Therefore, this wiring too must be provided with special protective encasement by the luminaire. This is generally accomplished by designing wire raceways in the luminaire to meet special requirements established by Underwriters Laboratories.

The ballasts currently in production are either magnetic ballasts or electronic ballasts. The input power is provided from 50 or 60 Hertz line voltage and the output of the ballast is connected to a lamp socket or sockets via interconnect wiring. The magnetic ballast generally consists of a transformer with a current limited output and a power-factor correction capacitor connected across the input. Since the magnetic ballast is operating at 60 Hertz, the size of the metal can of a ballast capable of handling 60 watts of output power is 2.25" wide by 1.5" high by 8" long and weighs about 3 pounds. Electronic ballasts are generally manufactured in the same size package but weigh 1.25 to 2.5 pounds.

OBJECTS AND ADVANTAGES

Accordingly, several objects and advantages of my invention are a lighter weight, lower cost luminaire with fewer parts, requiring significantly reduced storage and shipping volume, while still maintaining an attractive appearance and providing easy assembly. This is achieved by incorporating the lamp socket into the insulated enclosure of the ballast, thus enclosing any leads or terminals that exceed class II or class III limits within the insulated ballast enclosure. This allows the luminaire to be manufactured out of lighter weight less costly material and in most cases made as a single piece with no factory assembly of the luminaire. Due to the field assembly and the unique design of the reflector portion of the luminaire, the luminaires can be nested. This greatly reduces the shipping and storage volume. In the case of the preferred embodiment, the luminaire is capable of being assembled and installed by someone requiring no training as an electrician.

Still further objects and advantages will become apparent from a consideration of the ensuing description and accompanying drawings.

| | |
|---|---|
| 1 | 10 2' by 2' luminaire reflector |
| 2 | 12 edge A |
| 3 | 14 edge B |
| 4 | 16 edge C |
| 5 | 18 edge D |
| 6 | 20 ceiling grid opening |
| 7 | 22 lip |
| 8 | 24 top plane |
| 9 | 26 2D lamp |
| 10 | 28 aperture |
| 11 | 30 ballasted-socket assembly |
| 12 | 32 notches |
| 13 | 34 clip |
| 14 | 36 fluorescent tube |

-continued

| | |
|---|---|
| 15 | 38 plastic support structure |
| 16 | 40 lamp support clips |
| 17 | 42 2' by 2' lens |
| 18 | 44 enclosure |
| 19 | 46 grid system |
| 20 | 48 T-bars |
| 21 | 50 permanent ceiling |
| 22 | 52 support wires |
| 23 | 54 ceiling panels |
| 24 | 56 four-port energy-limited power sources |
| 25 | 58 luminaire assemblies |
| 26 | 60 conduit, BX, or Romex |
| 27 | 62 cable assembly |
| 28 | 66 output terminals |
| 29 | 68 four-pin lamp socket |
| 30 | 70 transformer |
| 31 | 72 filament windings |
| 32 | 74 ballasting capacitor |
| 33 | 76 tank capacitor |
| 34 | 78 tank inductor |
| 35 | 80 four-pin recessed plug |
| 36 | 82 depressions |
| 37 | 84 power receptacle |
| 38 | 86 power plug |
| 39 | 88 2' by 4' reflector |
| 40 | 90 2' by 4' lens |
| 41 | 92 2' by 4' ceiling grid opening |
| 42 | 94 compact fluorescent lamp socket |
| 43 | 96 cover plate |
| 44 | 98 mounting tab |
| 45 | 100 shaft |
| 46 | 102 ballast circuit housing |
| 47 | 104 ballasted-cover-plate |
| 48 | 106 compact fluorescent lamp |
| 49 | 108 power cable |
| 50 | 110 keyhole slots |
| 51 | 112 circular aperture |
| 52 | 114 sealable reflector |
| 53 | 116 double-sided tape |
| 54 | 118 adjacent grid opening |

SUMMARY

This invention is directed to a design of field assembled luminaires, primarily for suspended ceilings, which permits one luminaire reflector to be nested within one or more identical luminaire reflectors to minimize shipping and warehouse space. The lamp socket is manufactured as an integral part of the ballast, and clips into and is supported by the reflector. If a lens is desired to block direct view of the lamp, it is not necessary to provide the lens as part of a hinged door. The fact that the reflector can be made from much lighter material (plastic, metal, etc.) permits the lamps to be replaced by removing an adjacent ceiling tile and sliding the reflector over the open space in the grid to access the lamp or, in the case of compact fluorescent lamps, to replace the lamp from the rear.

DESCRIPTION

Preferred Embodiment

Figure 1:
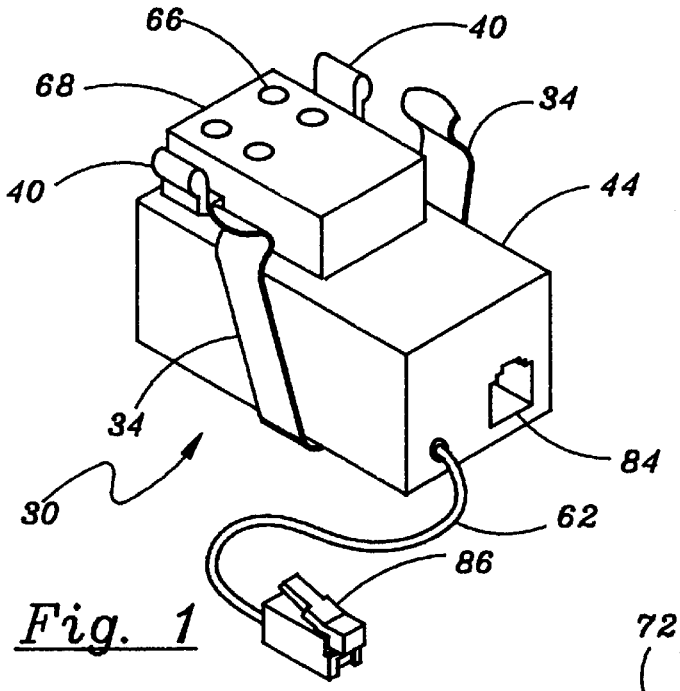
FIG. 1 shows a ballasted-socket assembly.

FIG. 1 shows a pictorial drawing of a ballasted-socket assembly 30. The enclosure 44 of the ballasted-socket assembly 30 is made of electrically insulating material and encases the electronic circuitry used to provide the necessary interface between a power source and a gas discharge lamp. The back of four-pin lamp socket 68 is encased by the enclosure 44. The four-pin lamp socket 68 is provided with four output terminals 66 and with lamp support clips 40 to support the weight of a lamp when it is mounted in the four-pin lamp socket 68. Clips 34 are provided on alternate sides of the enclosure 44 to hold the ballasted-socket assembly 30 in position when mounted on a luminaire reflector. The cable assembly 62 is used to connect the ballasted-socket assembly 30 to a power source via the power plug 86. An optional power receptacle 84 can be provided as part of the ballasted-socket assembly 30. This permits another ballasted-socket to be plugged into it.

Figure 2:
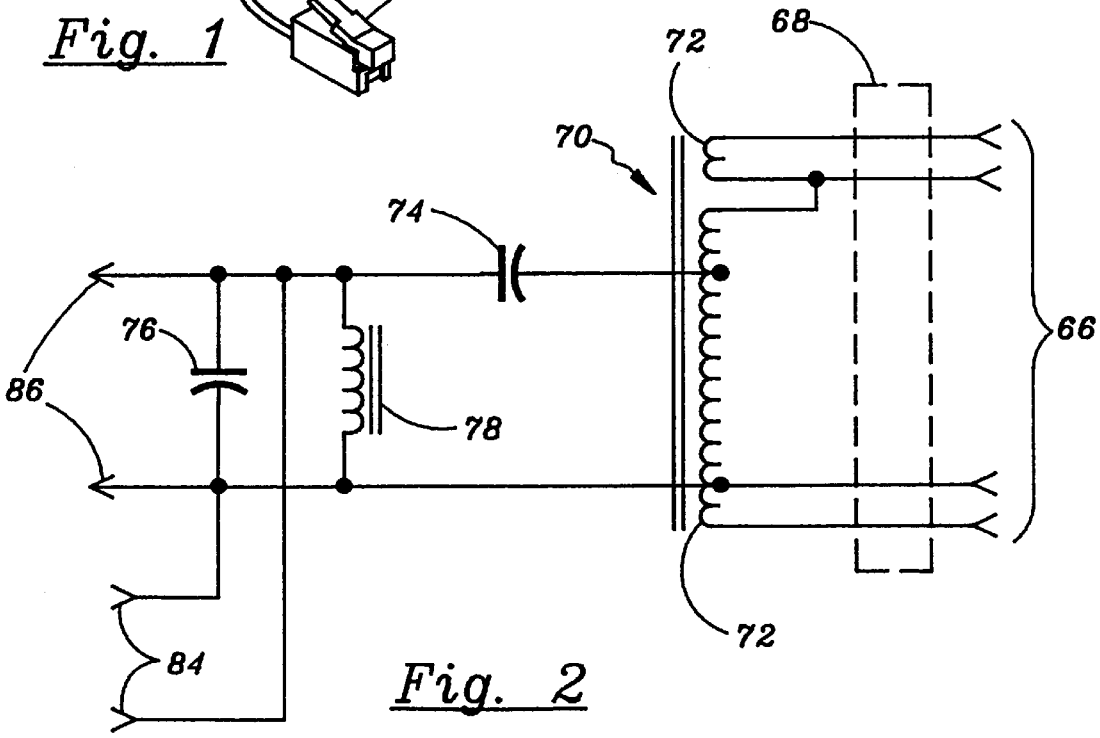
FIG. 2 shows schematically a typical ballasted-socket circuit.

FIG. 2 is a schematic of a typical ballasted-socket circuit. The power plug 86 is provided for connection to a power source. The output terminals 66 are part of the four-pin lamp socket 68 and provide voltage to heat lamp filaments and current-limited voltage to provide lamp current. Transformer 70 is used to step-up or step-down the lamp starting voltage as required by the particular lamp to be used and to supply filament voltage from the filament windings 72. Ballasting capacitor 74 limits the current supplied to the lamp after lamp ignition. Tank capacitor 76 and tank inductor 78, in concert with the reflected load and ballasting capacitor 74, form a parallel resonant tuned circuit. The optional power receptacle 84 is connected in parallel with the leads to power plug 86.

Figure 3:
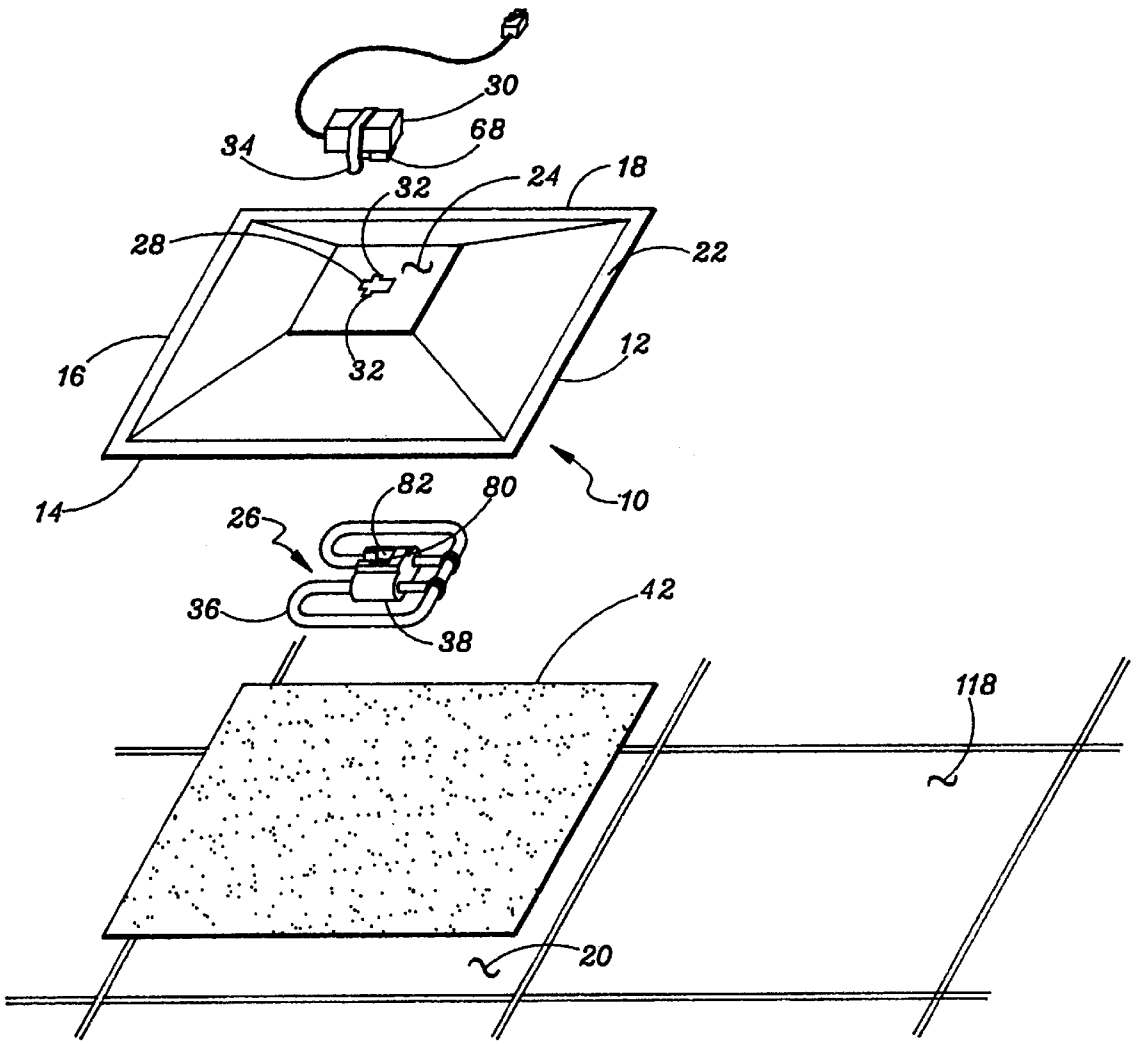
FIG. 3 is an exploded view of one embodiment of the Nestable Luminaire for single-ended lamps.

FIG. 3 is an exploded view of the instant invention showing the major components. The 2' by 2' luminaire reflector 10 in this embodiment is shown as a truncated pyramid. Edge A 12, edge B 14, edge C 16, and edge D 18 are each slightly less than two feet in length to permit the 2' by 2' luminaire reflector 10 to be placed into a 2 foot by 2 foot ceiling grid opening 20. A one-half inch lip 22 is provided around the circumference of the lower portion of the 2' by 2' luminaire reflector 10 to added rigidity to the reflector and to center the reflector within the 2 foot by 2 foot ceiling grid opening 20. The material used, in this embodiment for the 2' by 2' luminaire reflector 10, is a 0.060 inch thick, UV stabilized, white plastic with an HB flame rating. It should be noted that if the luminaire is intended to be used in a ceiling requiring a fire rating, it may be necessary to use metal in place of plastic to achieve the desired fire rating. Using plastic permits a wide variety of shapes to easily be manufactured by vacuum forming or injection molding. The top plane 24 measures approximately 12 inches by 12 inches. A typical height for the luminaire is 3 and ¾ inches. The angle of inclination of each of the sides is slightly greater than 30 degrees. The 12-inch by 12-inch dimension of the top plane 24 is determined by the lamp chosen for the luminaire. For this embodiment a General Electric F55 2D lamp 26, which is approximately 8inches by 8inches, is used. An aperture 28 is provided centered in the top plane of the 2' by 2' luminaire reflector 10 to receive ballasted-socket assembly 30. The aperture 28 has notches 32 on alternate sides to receive mating clips 34 located on the ballasted-socket assembly 30 to insure that the ballasted-socket assembly 30 is rigidly held in place once installed.

FIG. 3 also shows how the ballasted-socket assembly 30 is positioned relative to the 2' by 2' luminaire reflector 10. The clips 34 are to insure adequate lateral force is available to maintain the ballasted-socket assembly 30 in position when the clips 34 are inserted into the notches 32 of aperture 28.

The 2D lamp 26 shown in FIG. 3 is a General Electric 2D lamp or similar type. The 2D lamp 26 consists of a single fluorescent tube 36 that is bent to resemble two capital "Ds" back to back. The two ends of the fluorescent tube 36 each terminating at a plastic support structure 38. A four-pin recessed plug 80 is provided in the approximate center of the plastic support structure 38. The lamp also being provided with depressions 82 on alternate sides of the recessed plug 80 to receive the lamp support clips 40 shown in FIG. 1.

The optional 2' by 2' lens 42 can be a simple plastic diffuser, parabolic louver, baffle or any of the standard lens materials used with conventional luminaires. The dimension of each edge of the optional 2' by 2' lens 42 is slightly less than two feet in length to permit the optional 2' by 2' lens 42 to be placed into the 2 foot by 2 foot ceiling grid opening 20. Adjacent grid opening 118 is one of the four possible grid openings that share a common side with the grid opening containing the luminaire.

Figure 4:
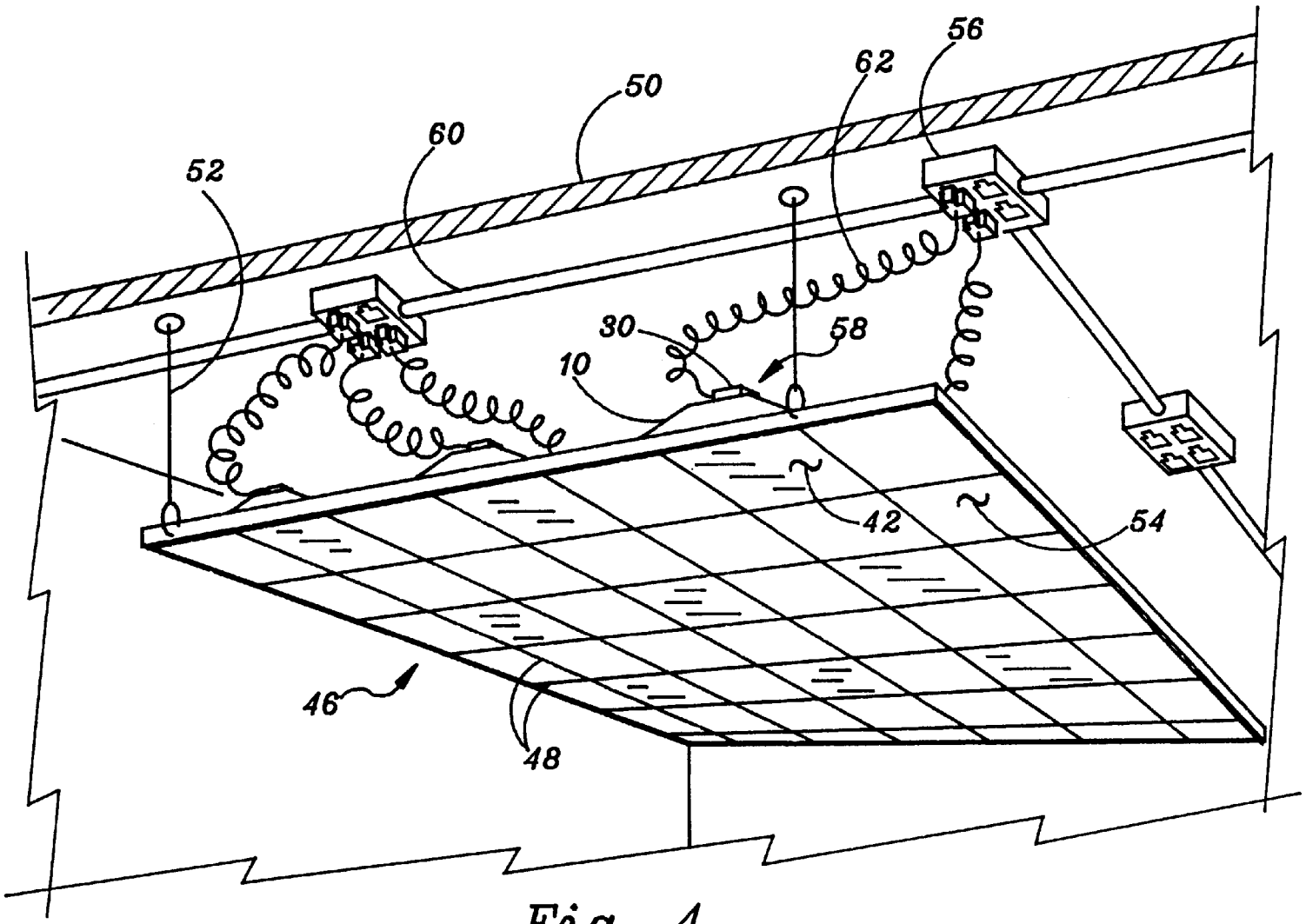
FIG. 4 shows how an overall system is installed in a suspended ceiling.

FIG. 4 shows how the overall system is installed in a suspended ceiling. A grid system 46 made up of T-bars 48 is suspended from a permanent ceiling 50 using support wires 52. The T-bars 48 are installed to provide either a 2' by 2' or a 2' by 4' grid. Luminaire assemblies 58 placed into the grid as required to provide the desired level of lighting. In FIG. 4 the luminaire assemblies 58 are shown in every other opening of every other row. The remaining openings are filled with ceiling panels 54. Mounted onto the permanent ceiling 50 are a series of four-port energy-limited power sources 56, one four-port energy-limited power sources 56 for every four luminaires assemblies 58. The four-port energy-limited power sources 56 are connected to the utility power line using conduit, BX, or Romex 60 as required by the local electrical code. The four-port energy-limited power source 56 is connected to the ballasted-socket assembly 30 using a lightweight cable assembly 62. The ballasted-socket assembly 30 is affixed to the top of the 2' by 2' luminaire reflector 10. An optional 2' by 2' lens 42 may be inserted in the grid system 46 ahead of the 2' by 2' luminaire reflector 10.

Figure 5:
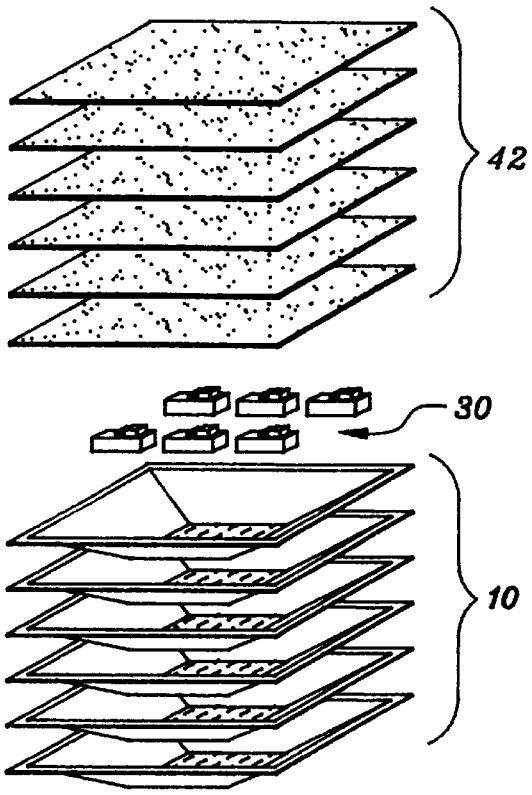
FIG. 5 shows how multiple luminaires can be nested together for shipping and storage.

FIG. 5 is an exploded view showing how multiple luminaires can be nested together for shipping and storage. This figure shows six reflectors 10 nested one within another. Six ballasted-sockets 30 can be placed within the center cavity of the top reflector. Six 2' by 2' lenses 42 are then stacked on top of the top reflector 10.

Figure 6:
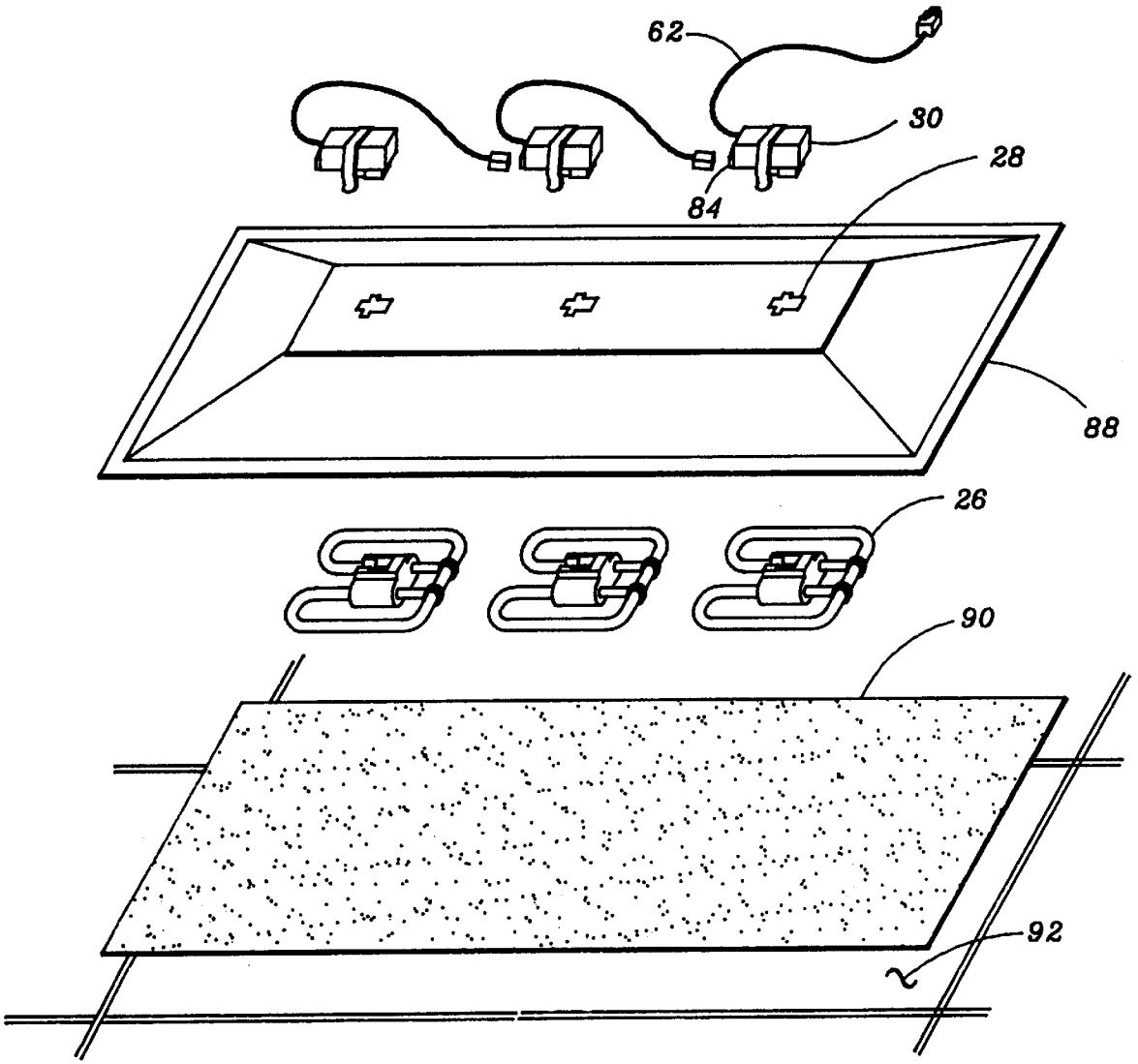
FIG. 6 shows how the same invention can be applied to 2' by 4' luminaires.

FIG. 6 shows an exploded view of a 2' by 4' luminaire. The 2' by 4' reflector 88 contains three apertures 28 to receive three ballasted-socket assemblies 30 each of which is provided with cable assembly 62 and power receptacle 84. Three 2D lamps 26 are inserted into the ballasted-sockets from the bottom side of the 2' by 4' reflector 88. The 2' by 4' lens 90 is shown located above 2' by 4' grid opening 92.

Figure 7:
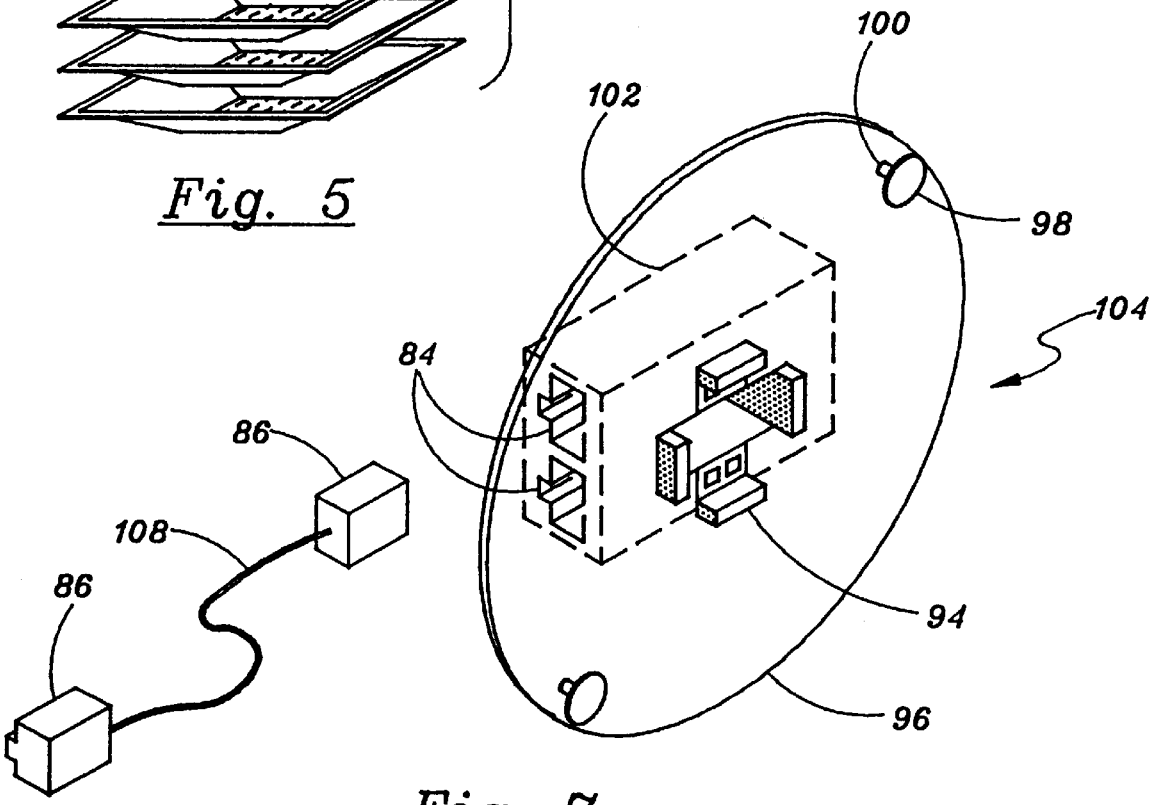
FIG. 7 shows a variation of the ballasted-socket which allows lamps to be replaced from the rear of the luminaire.

FIG. 7 shows a ballasted-cover-plate 104 for compact fluorescent lamps. Compact fluorescent lamp socket 94 projects through the center of the cover plate 96. Mounting tabs 98 are round discs approximately 0.3 inches in diameter located in a plane parallel to the cover plate 96 and 0.060 inches above it. The mounting tabs are held in place by a shaft 100, which is affixed into the cover plate 96. The ballast circuit housing 102 encloses all circuitry, the back of compact fluorescent lamp socket 94 and two power receptacles 84. Also shown is power cable 108 with power plug 86 attached to each end.

Figure 8:
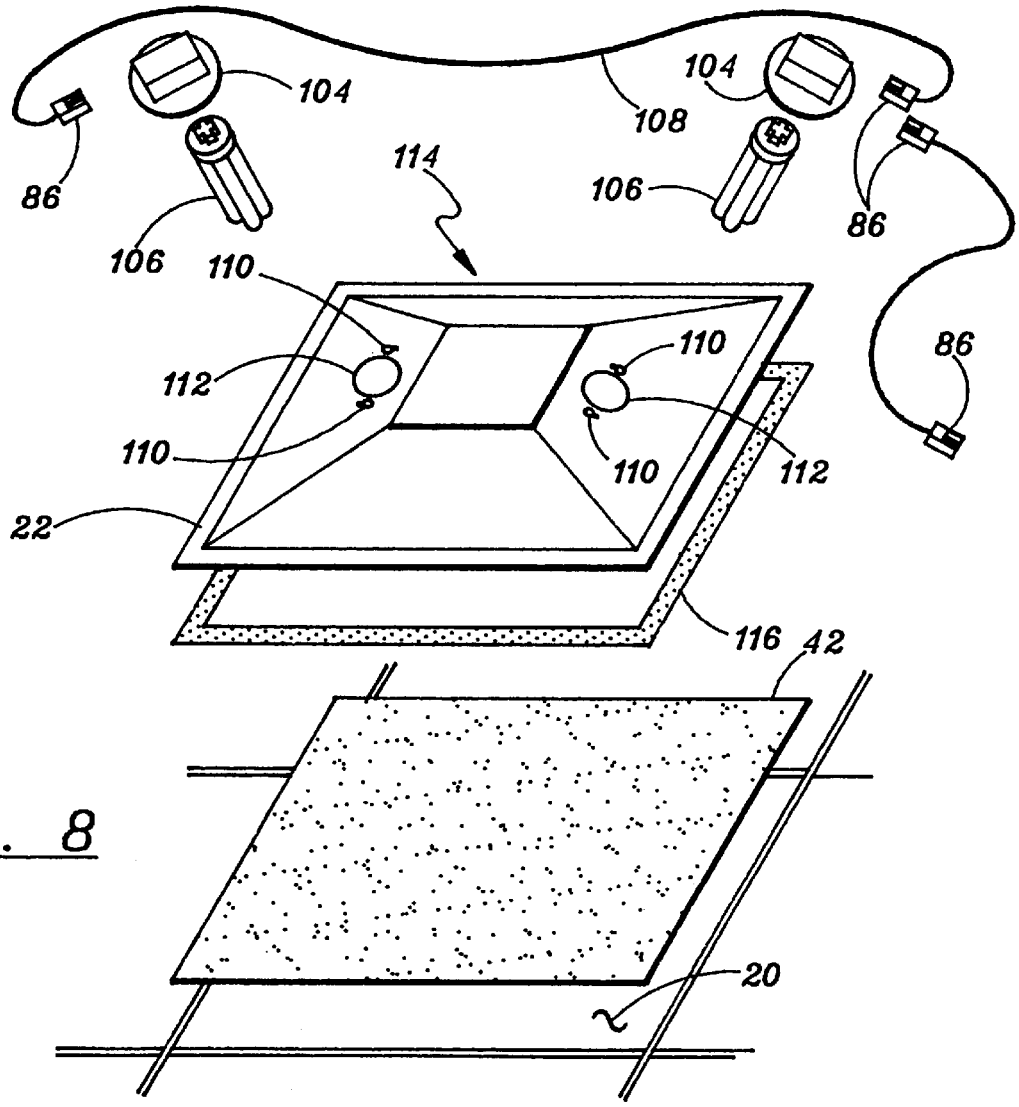
FIG. 8 shows how the invention can be applied to luminaires using one or more compact fluorescent lamps.

FIG. 8 shows how the invention can be applied to luminaires, which use one or more compact fluorescent lamps. The sealable reflector 114 is provided with one or more circular apertures 112 with keyhole slots 110 on opposite sides of the aperture. The ballasted-cover-plate 104 is provided with a socket to receive compact fluorescent lamp 106. The ballasted-cover-plate is also provided with two power receptacles, either of which can receive power cable 108. Power cable 108 is provided with power plugs 86 at each end. An optional strip of double-sided tape 116 can be supplied with the sealable reflector 114. Beneath the sealable reflector is lens 42 that is positioned above a 2' by 2' ceiling grid opening 20.

OPERATION

Preferred Embodiment

Referring to FIG. 1, the ballasted-socket 30 encapsulates the ballast circuitry, all wiring, plus the connections between the ballast circuitry and the four-pin lamp socket 68; therefore, the ballasted-socket 30 is the only part of the luminaire which must meet the stringent requirements regarding the enclosure of fluorescent lighting fixtures established by Underwriters' Laboratories, Inc. in UL1570. Input power is provided to the ballasted-socket assembly 30 through power plug 86 and cable assembly 62. An alternative connection technique, not shown, is to use insulation displacement connectors built into the ballasted-socket assembly 30 into which a multi-conductor cable is inserted and a cover or cam is slid or rotated into place to make the connection via contact point which pierce the insulation, similar to the plugs that are added to lamp cords.

FIG. 2 is typical of a circuit, which can be used in a ballasted-socket assembly or ballasted-cover-plate. In the preferred embodiment, the circuit is designed to be powered from a class II or class III power-limited supply. As a result, the National Electrical Code does not require the interconnecting wires between the power supply and the ballasted-socket assembly to be run in conduit or BX, but permits much lighter weight non-armored cable to be used. In order to minimize the physical size of the electronic components used for the ballast circuitry (tank capacitor 76, tank inductor 78, ballasting capacitor 74, and transformer 70) an operating frequency in the range of 18 kHz to 100 kHz is preferred. The filament windings 72 provide voltage to heat the lamp filaments for rapid start operation. By increasing the secondary turns and eliminating the filament windings, instant start operation can be achieved.

Referring to FIG. 3, a complete luminaire consists of a ballasted-socket assembly 30, a lamp 26, an optional lens 42 and the 2' by 2' luminaire reflector 10. The reflector merely supports the ballasted-socket assembly 30 and reflects the light down to the room being illuminated, but does not enclose any wires, transformers, capacitors, ballasts, current-carrying parts, devices with exposed metal, leads or terminals for field connection of supply wires; therefore, the enclosure requirements of UL1570 do not have to be met by the reflector portion of the luminaire. This means that the reflector can be manufactured out of much lighter gauge material than that required for the equivalent conventional luminaire. The luminaires can be shipped to the job site in bulk (i.e. the 2' by 2' luminaire reflectors 10 can packed by nesting one reflector within another). As a result, the equivalent of ten conventional 2' by 2' troffer type luminaires can be placed in on container measuring 2' by 2' by 6" thick and weigh a total of only 25 pounds including the reflectors, ballasted-sockets, and lenses. Ten conventional 2' by 2' troffers would normally be packed in individual boxes measuring 2' by 2' by 5" thick and create a stack over four feet tall weighing 150 pounds. It would take sixty nestable luminaires to add up to 150 pounds and they would only stand 12 inches tall. Each additional reflector increases the height of the stack by only slightly more than the material thickness of the reflector.

Since the luminaire reflector 10 can be made out of a single sheet of material, this piece can be inexpensively manufactured by being vacuum formed or injection molded in the case of plastic, or either drawn or fabricated out of a single sheet of steel or aluminum. In situations where the luminaire is installed without a diffuser for a lens, it is possible to provide a textured finish on the reflecting side of the reflector to greatly reduce the amount of glare that would otherwise be produced by the glossy painted surface of a conventional luminaire.

In its basic form, the nestable luminaire can be manufactured with a single piece reflector. This is the only part requiring significant tooling. It does not require the tooling of numerous channels, covers and clips, that is required for the equivalent conventional luminaire. Thus, the tooling cost to get into the luminaire business using the nestable luminaire approach is dramatically less than the cost to get into the business of manufacturing conventional luminaire designs. Again, due to the fact that the physical volume required to ship a finished reflector is no more and in some cases actually less than the volume to ship the raw material, the luminaire reflector can be manufactured anywhere in the world and shipped to the job site for 2% of what it would cost to ship conventional luminaires. Therefore. the suppliers of the luminaire reflectors are not limited to domestic vendors. There is no factory wiring; therefore, there is no manufacturing space or labor required for wiring the nestable luminaire.

As seen in FIG. 3 the entire luminaire can be assembled from three components, the luminaire reflector 10, the ballasted-socket assembly 30 and a lamp 26. An optional lens 42 can be added to reduce glare. As stated previously one of the key features of the nestable luminaire is its dramatic reduction in shipping and warehousing volume. In order to achieve the maximum reduction in volume the luminaire is shipped disassembled. It is therefore necessary that the luminaire is capable of being easily assembled at the job site. As shown in FIG. 3 the ballasted-socket 30 is merely clipped into the luminaire reflector 10 using the clip 34. The lamp 26 is then inserted into the four-pin lamp socket 68 of the ballasted-socket assembly 30. If a lens is used, the lens 42 is placed into the ceiling grid opening 20. The reflector 10, which also has the lamp 36 and ballasted-socket 30 installed, is placed over the lens 42 into the ceiling grid opening 20 from an adjacent grid opening 118. This installation process becomes a much easier task since the weight of a 2' by 2' luminaire is less than 3 pounds instead of 15 and in the case of a 2' by 4' luminaire the weight is less than 6 pounds instead of nearly 30. It should be noted that a significant portion of the shipping advantage of the nestable luminaire can still be achieved with ballasted-socket installed before shipping.

Referring to FIG. 4, once the luminaire has been placed into the suspended ceiling grid system 46 the cable assembly 62 is plugged into a four-port energy-limited power source 56 (for an example of an acceptable energy-limited power source see U.S. Pat. No. 5,691,603). Since in the case of an energy-limited system the wiring between the power source and the luminaire is class II or class III, it is only necessary to have an electrician install the four-port energy-limited power sources 56. The wiring between the power source and the luminaire can be installed by unskilled labor, because the wiring merely plugs together. Even where unions may require the luminaires to be installed by electricians, the speed at which the luminaires are installed will be very much increased and installation cost very much reduced.

FIG. 5 shows how the reflectors 10 can be nested one within another and one possible way of packaging the luminaires as do-it-yourself (DIY) kits. In this case, six reflectors 10 are packed with six ballasted-sockets 30 packed in the center of the top reflector. The lenses 42 are then packed on top of the upper reflector. This kit of six luminaires will fit in roughly the same size container that is currently used for a single equivalent conventional luminaire. Another alternative for both the DIY market and the commercial market is to ship the reflectors 10, ballasted-sockets 30, lenses 42 and lamps 26 separately in bulk, perhaps 50 to 100 per container. This way the do-it-yourselfer or commercial user can mix and match reflectors, ballasted-sockets, lenses and lamps. Also, if the aperture 28 of the reflector 10 (see FIG. 3) and the mounting technique of the ballasted-socket 30 were standardized, then the end user can choose a ballasted-socket from one of a number of ballast manufacturers on a reflector assembly from one of several luminaire manufacturers. The shelf space savings generated by the reduced volume of the nestable luminaire is especially important to the lighting retailer and home improvement center, where the shelf space is particularly valuable, since the merchandise is often warehoused on the store shelves.

FIG. 6 shows how the same invention can be applied to a 2' by 4' luminaire. The 2' by 4' reflector 88 contains one or more apertures 28. The ballasted-sockets 30 are clipped into the 2' by 4' reflector 88. The lamps 26 are inserted into the ballasted-sockets 30. The luminaires are then installed into the ceiling grid as previously discussed. To minimize the wiring above the suspended ceiling, each ballasted-socket 30 can be provided with a power receptacle 84 allowing one ballasted-socket 30 to be plugged into the preceding one with only one cord assembly 62 run back to the power source. All comments regarding the nesting, shipping, and warehousing previously discussed also apply to this type of luminaire.

The ballasted-cover-plate 104 in FIG. 7 is similar to the ballasted-socket assembly 30 except the ballast circuitry is mounted on a cover plate 96. A compact fluorescent lamp socket 94 is mounted on the cover plate 94 also. In the configuration shown, access to the compact fluorescent lamp socket 94 is through the cover plate. In other configurations, the lamp socket 94 may be mounted on the cover plate 96 without requiring that the base of a lamp extend through the cover plate 96. The diameter of the cover plate 96 is made slightly larger than the base of a compact fluorescent lamp. As an alternative to having a cable assembly as part of the ballasted-socket, the ballasted-cover-plate 104 is shown with two parallel connected power receptacles 84. A separate power cable assembly 108 is provided with power plugs 86 at each end to interconnect the ballasted-cover-plate 104 to a power source.

Using a ballasted-cover-plate 104 permits relamping from the rear of the fixture as is shown in FIG. 8. A compact fluorescent lamp 106 is inserted into the compact fluorescent lamp socket of the ballasted-cover-plate 104. The compact fluorescent lamp is inserted through the circular aperture 112. The two mounting tabs 98 (shown in FIG. 7) are placed through the large ends of the two keyhole slots 110 located on both sides of circular aperture 112. The ballasted-cover-plate 104 is then rotated to lock it in place. If more than one lamp is used, the same procedure is followed for the remaining lamps. If a diffuser is used for the lens 42, the luminaire can be sealed by removing the paper backing from one side of the double-sided tape 116 and attach it to the bottom side of lip 22 around the perimeter of the luminaire. The lens 42 is then placed into the ceiling grid opening 20. The backing is removed from the double-sided tape 116. The sealable reflector 114 is then inserted through an adjacent grid opening and placed over the lens 42. Once in place, the double-sided tape adheres to the lens 42 and forms a sealed unit minimizing the infiltration of dirt. When a lamp reaches its end of life, the ballasted-cover-plate 104 is removed from the rear of the sealable reflector 114, the lamp is replaced with a new one and the ballasted-cover-plate 104 is reinstalled. It may be more cost effective in some cases to have the double-sided tape 116 preinstalled on the lens or the reflector by the manufacturer.

It should be noted that the sides of the reflector can be designed to be much steeper. As the sides of the reflector get steeper the improvement in packing density is somewhat decreased and is a function of the angle of the sides plus the thickness of the material used to manufacture the reflector, but significant improvement in the packing density compared to individually boxed luminaires is still achieved. For instance, if the reflector is designed such that a second reflector nested over it creates a gap of 1 inch between the top planes 24 of the two reflectors and the height of each reflector is approximately 4 inches, when ten reflectors are shipped nested, they will still only occupy roughly one-third of the volume of individually boxed conventional luminaires. With a design that creates a gap between top planes, the option exists to supply the ballasted-socket assemblies preinstalled either on the backside as has been shown, or with minor modifications to the mounting arrangements and power input connection it can be preinstalled on the inside of the reflector.

Conclusions, Ramifications, and Scope

Accordingly, it can be seen that the invention provides a dramatic reduction in the cost to manufacture, ship and store luminaires. In addition, substantial savings in the cost of installation are achieved since the luminaires can easily be assembled, installed and connected to the power source by non-skilled, non-electrician installers.

Although the description above contains many specificities, these should not be construed as limiting the scope of the invention but as merely providing illustrations of some of the presently preferred embodiments of this invention. Various other embodiments and ramifications are possible within it's scope. For example, although the preferred embodiment describes the nestable luminaire with a ballasted-socket designed for a class II or class III high-frequency power input, the nestable luminaire concept can also be used with non-class II or III, AC and DC circuits. The ballasted-socket in these situations would merely have to enclose all non-class II and III circuits and wiring, while the input connection would have to meet the local codes that may apply.

While the specification of the preferred embodiment discusses the field assembly of the nestable luminaire and how the ballasted-socket is clipped into the luminaire's reflector, much of the reduction of the in shipping volume can still be achieved with the ballasted socket already mounted in the reflector.

While the preferred embodiment discusses the use of plastic for the reflector material, under certain circumstances it will be advantageous to use other materials, such as metal, fiberglass, etc. The preferred embodiment shows the shape of the reflector to be a truncated pyramid, but any structural shape which will function as a reflector and allow one reflector to be nested within another for shipping purposes is suitable for this purpose. The preferred embodiment is presented in terms of 2'×2' and 2'×4' luminaires. While these luminaires are currently the most common, the invention works equally well on 1'×1', 1'×2', 1'×4', etc. and metric sizes as well.

Thus, the scope of the invention should be determined by the appended claims and their legal equivalents, rather than by the examples given.

Definitions luminaire: a complete lighting unit consisting of a lamp or lamps together with the parts designed to distribute the light, to position and protect the lamps, and to connect and interface the lamps to the power source.

troffer: a recessed lighting unit, installed with the opening flush with the ceiling.

compact fluorescent lamps: single-ended fluorescent lamps such as, Biax, double Biax, triple Biax, quad Biax, flat, helical, spring, etc.

high-frequency: frequencies greater than 10 kHz.

I claim:

1. A luminaire for a suspended ceiling comprising:

a reflector having a tapered side wall or walls which allow it to be stacked on top of an identical reflector, such that, the total height of the two nested reflectors is less than 50% taller than the height of a single reflector, the reflector having at least one aperture for the insertion of a ballasted-socket assembly; and a ballasted-socket assembly comprising: a power input connection, ballasting circuitry to properly power a gas-discharge lamp, a gas-discharge lamp socket, and an enclosure that contains and completely encloses: said ballasting circuitry, the connections to said gas-discharge lamp socket, and the interconnection between the output of said ballasting circuitry and said gas-discharge lamp socket; and a gas-discharge lamp.

2. The luminaire recited in claim 1, wherein the ballasted-socket assembly is connected to and powered from a power source;

said power source having an output which is limited to 250 volt-amperes or less.

3. The luminaire recited in claim 1, wherein the ballasted-socket assembly is connected to and powered from an output of a power source;

said being turned off for at least 90% of the time if the current drawn from the output exceeeds a predetermined limit while said output is turned on.

4. The luminaire recited in claim 1, wherein the ballasted-socket assembly is connected to the wiring from the power source using an insulation displacement connection.

5. The luminaire recited in claim 1, wherein the ballasted-socket assembly is disconnectably connected to a power source using a power plug.

6. The luminaire recited in claim 1, wherein the reflector is non-metallic.

7. The luminaire recited in claim 1, wherein the reflective side of the reflector includes a textured surface.

8. The luminaire recited in claim 1, wherein a lens is placed between the suspended ceiling grid and the reflector.

9. The luminaire recited in claim 1, wherein the ballasted-socket assembly clips or snaps into the reflector aperture.

10. The luminaire recited in claim 1, wherein the ballasted-socket assembly is inserted into said aperture and then rotated in order to affix it to the reflector.

11. The luminaire recited in claim 1, wherein the luminaire contains multiple gas-discharge lamps.

12. The luminaire recited in claim 1, wherein the luminaire is so constructed to permit relamping from the back or the side of the luminaire.

13. The luminaire recited in claim 12, wherein the luminaire is provided with a lens that is permanently affixable to the luminaire during field assembly.

14. The luminaire recited in claim 1, wherein the luminaire is a troffer.

15. The luminaire recited in claim 1, wherein power is provided by high-frequency AC voltage.

16. The luminaire recited in claim 1, wherein power is provided by a high-frequency AC voltage with an rms magnitude less than 60 volts.

17. The luminaire recited in claim 1, wherein power is provided by a high-frequency AC voltage with an rms magnitude less than 150 volts.

18. A structural element adapted for mounting in a suspended ceiling wherein said structural element: (i) is operable as a reflector for a light source providing illumination for the space below said suspended ceiling, (ii) has an aperture to permit the mounting of a receptacle operable to make electrical connection to a power source and to receive, provide connection to and hold an electric lamp, (iii) has a certain height, (iv) is of such a shape as to permit one such structural element to be nested within another such that two such elements, when so nested, will exhibit a combined height no more than 50 percent higher than said certain height.

19. The structural element recited in claim 18, wherein said electrical connection is to a power source having an output current that is limited to a value that is less than 1.5 amps rms and a voltage that is less than 60 volts rms.

20. The structural element recited in claim 18, wherein said electrical connection is to a power source having an output current that is limited to a value that is less than 1.5 amps rms and a voltage that is less than 150 volts rms.

21. The structural element recited in claim 18, wherein the recepticle is connected to the wiring from the power source using an insulation displacement connection.

22. The structural element recited in claim 18, wherein said electrical connection is made using plug-in connectors.

23. The structural element recited in claim 18, wherein said structural element is non-metallic.

24. The structural element recited in claim 18, wherein the reflective side of said structural element includes a textured surface.

25. The structural element recited in claim 18, wherein a lens is placed between the suspended ceiling grid and said structural element.

26. The structural element recited in claim 18, wherein said receptacle clips or snaps into the aperture.

27. The structural element recited in claim 18, wherein said receptacle must be placed into said aperture and then rotated in order to affix it to the structural element.

28. The structural element recited in claim 18, wherein said structural element contains multiple electric lamps.

29. The structural element recited in claim 18, wherein said structural element is constructed to permit relamping from the back or the side of said structural element.

30. The structural element recited in claim 18, wherein the structural element is provided with a lens that is permanently affixed to the structural element during field assembly.

31. The structural element recited in claim 18, wherein said electric connection is made to a source of high-frequency AC voltage and the structural element is used as a troffer.

32. The structural element recited in claim 18, wherein the structural element is used as a troffer.

33. The structural element recited in claim 18, wherein said electric connection is made to a source of high-frequency AC voltage.

34. The structural element recited in claim 18, wherein said electric connection is made to a source of high-frequency power;

said source of high-frequency power having an output current that is limited to a value that is less than 1.5 amps rms and a voltage that is less than 60 volts rms.

35. The structural element recited in claim 18, wherein said electric connection is made to a source of high-frequency power;

said source of high-frequency power having an output current that is limited to a value that is less than 1.5 amps rms and a voltage that is less than 150 volts rms.

36. A field assembled luminaire for a suspended ceiling comprising:

a ballasted-socket assembly for compact flourescent and other single-ended gas discharge lamps;

said ballasted-socket assembly including: a high-frequency power input connection, ballasting circuitry to properly power a gas-discharge lamp, a lamp socket adapted to receive and hold such a lamp, and an enclosure that contains and completely enclosed: said ballasting circuitry, the connections to said lamp socket, and the interconnection between the output of said ballasting circuitry and said lamp socket;

said enclosure not including a gas-discharge lamp;

a reflector which is supported by a suspended ceiling grid system;

said reflector capable of receiving said ballast-socket assembly; and a gas-discharge lamp.

37. A luminaire for a suspended ceiling;

said luminaire having a gas-discharge lamp, a lens, and a reflector;

said lens permanently attached to said relector at the time of luminaire installation.

38. The luminaire recited in claim 37 wherein, said permanent attachment being accomplished with adhesively coated gasket material that is provided as part of the reflector or lens.

39. The luminaire recited in claim 37 wherein, said lamp is replaced from the rear of the luminaire.

40. A luminaire for a suspended ceiling comprising: a lamp, a reflector and a ballasting circuit with an integral lamp socket;

said ballasting circuit with integral lamp socket, lamp, and reflector each shipped separately; and said luminaire is assembled at the time of installation into the suspended ceiling ao at the site of the suspended ceiling.

41. A functional luminaire for a suspended ceiling comprising: a connection to a source of high-frequency power, a lamp socket, a lamp, a reflector, ballasting circuitry and an enclosure;

said enclosure completely enclosing the ballasting circuitry and the connections to the lamp socket;

said luminaire being supplied with no output wiring to the lamp existing outside of said enclosure;

said enclosure not enclosing the lamp.

42. A ballast-socket assembly comprising: a power input connection suitable for connection to a source of high-frequency voltage, ballasting circuitry to properly power a gas-discharge lamp, a gas-discharge lamp socket, and an enclosure;

said enclosure containing and completely enclosing: said ballasting circuitry, the connections to said gas-discharge lamp socket, and the interconnection between the output of said ballasting circuitry and said gas-discharge lamp socket;

said enclosure not containing or completely enclosing a gas-discharge lamp.

43. A combination comprising:

the assembly described in claim 42; and a source of high-frequency voltage, said source of high-frequency voltage having its output limited to 250 volt-amperes or less.

44. The assembly described in claim 42, wherein the power input connection is provided via an integral power cable:

said power cable having a power plug;

the power plug having two or more plug terminals;

the power receptacle having two or more receptacle terminals;

each receptacle terminal being electrically connected to a corresponding plug terminal.

45. The assembly described in claim 42, wherein the input power is provided via either of two parallel connected power receptacles.

46. The assembly described in claim 42, wherein the bulk of the ballast-socket assembly is designed to be located external to the luminaire;

said ballast-socket assembly being a separately packaged assembly that does not contain an inverter.

47. The assembly described in claim 42, wherein said ballast-socket assembly is used in combination with a luminaire for installation into a ceiling;

said luminaire having a reflector;

said reflector being of such shape to allow a second reflector to be stacked on top of the first reflector;

the two reflectors when so stacked having a combined height no more than 50% higher than that of a single reflector.

48. The assembly described in claim 42, wherein the ballast-socket assembly does not contain an electronic inverter circuit.

49. A ballast-socket assembly comprising: a power input connection suitable for connection to a source of high-frequency voltage, ballasting circuitry to properly power a gas-discharge lamp, lamp socket, an enclosure and a cover plate;

said enclosure containing and completely enclosing: said ballasting circuitry, the connections to said lamp socket, and the interconnection between the output of said ballasting circuitry and said lamp socket;

said enclosure not containing or completely enclosing a gas-discharge lamp.

50. The assembly described in claim 49, wherein said enclosure is formed at least in part by the cover plate.

51. The assembly described in claim 49, wherein the power input connection is provided via an integral power cable;

said power cable having a power plug;

the power plug having two or more plug terminals;

the assembly including a power receptacle;

the power receptacle having two or more receptacle terminals;

each receptacle terminal being electrically connected to a corresponding plug terminal.

52. The assembly described in claim 49, wherein the input power is provided via either of two parallel connected receptacles.

53. The assembly described in claim 49, wherein the bulk of the ballast-socket assembly is located external to the luminaire;

said ballast-socket assembly being a separately packaged assembly that does not contain an inverter.

54. The assembly described in claim 49, wherein the cover plate makes up part of said enclosure;

the assembly being provided with a gas-discharge lamp;

said cover plate removably mounted to the outside of a reflector;

the cover plate when so mounted providing access for the replacement of said gas-discharge lamp.

55. The assembly described in claim 49, wherein the ballast-socket assembly does not contain an electronic inverter circuit.

* * * * *